United States Patent [19]

Hulegard

[11] 4,124,497

[45] Nov. 7, 1978

[54] APPARATUS FOR SEPARATING MINERAL AND THE LIKE FROM EARTH AND THE LIKE

[76] Inventor: Trueman L. Hulegard, 14411 Round Lk. Rd., Anoka, Minn. 55303

[21] Appl. No.: 702,112

[22] Filed: Jul. 2, 1976

[51] Int. Cl.[2] ..... B03B 1/00; B03B 5/66

[52] U.S. Cl. ..... 209/3; 209/161; 241/188 R

[58] Field of Search ..... 209/158–161, 209/207, 208, 3, 211, 17; 241/20, 24, 188 R, 172; 210/513, 532, 533, 537

[56] References Cited

U.S. PATENT DOCUMENTS

| | | | |
|---|---|---|---|
| 630,309 | 8/1899 | Aberg | 209/211 |
| 1,277,145 | 8/1918 | Sowers et al. | 209/161 X |
| 2,854,136 | 9/1958 | Gillie et al. | 209/158 |

FOREIGN PATENT DOCUMENTS

| | | | |
|---|---|---|---|
| 679,906 | 8/1939 | Fed. Rep. of Germany | 209/159 |
| 1,345,193 | 10/1963 | France | 209/17 |

*Primary Examiner*—Frank W. Lutter
*Assistant Examiner*—Ralph J. Hill
*Attorney, Agent, or Firm*—Wicks & Nemer

[57] ABSTRACT

An apparatus for separating minerals and the like from earth and the like which includes a tank including a tank having an upper portion and a lower portion having a frusto-conical formation. The lower tank portion terminates in a chamber from which extends an outlet for separated material. The top of the tank has an outlet and an inlet. The tank also includes an auger for causing a flow of liquid in the tank portions from within the chamber upwardly and into said lower and upper portions. The tank has baffle members and on the tank arcuate bar members connected to the auger for separating material. A fluid injection inlet is connected to said chamber for introducing fluid under pressure into the chamber and an outlet on said chamber separated material. The tank also includes a bypass conduit on the outside of the tank and leading into the tank at the juncture of the upper and lower tank portions for use with relatively light weight material to be separated.

4 Claims, 9 Drawing Figures

APPARATUS FOR SEPARATING MINERAL AND THE LIKE FROM EARTH AND THE LIKE

SUMMARY

The invention relates to an improvement in an apparatus for separating minerals and the like from earth and the like. The apparatus includes an upper chamber which terminates at its lower end in an intermediate frusto-conical chamber terminating at its lower end in a lower chamber. Extending from the lower chamber upwardly through the intermediate and upper chamber is an auger. Earth including for example, BB shot to be reclaimed from the earth and accompanying grass, broken pieces clay pigeon, etc., is introduced into the top into the lower chamber under pressure with a water level maintained near the top of the upper tank. With the upward movement of water due to the pressure and the convolutions of the auger, the earth, and relatively light material stays at the top of the upper tank where it exits out the upper outlet pipe. The heavy material to be reclaimed, such as BB shot, falls due to the gravity and exits out the removal pipe extending from the lower chamber.

Material which is heavier than earth grass and the like such as the pieces of clay pigeons and light rock settles to and flows out intermediate outlet pipes leading from the intermediate chamber.

The upper tank includes devices for shredding breaking up and deflecting the material to thereby separate the earth grass and BB shot. The upper and intermediate tanks include arcuate beater bars extending from the auger.

In the drawings forming part of this application:

FIG. 1 is a side elevational view of an apparatus for separating minerals and the like from earth and the like.

Figure 1:
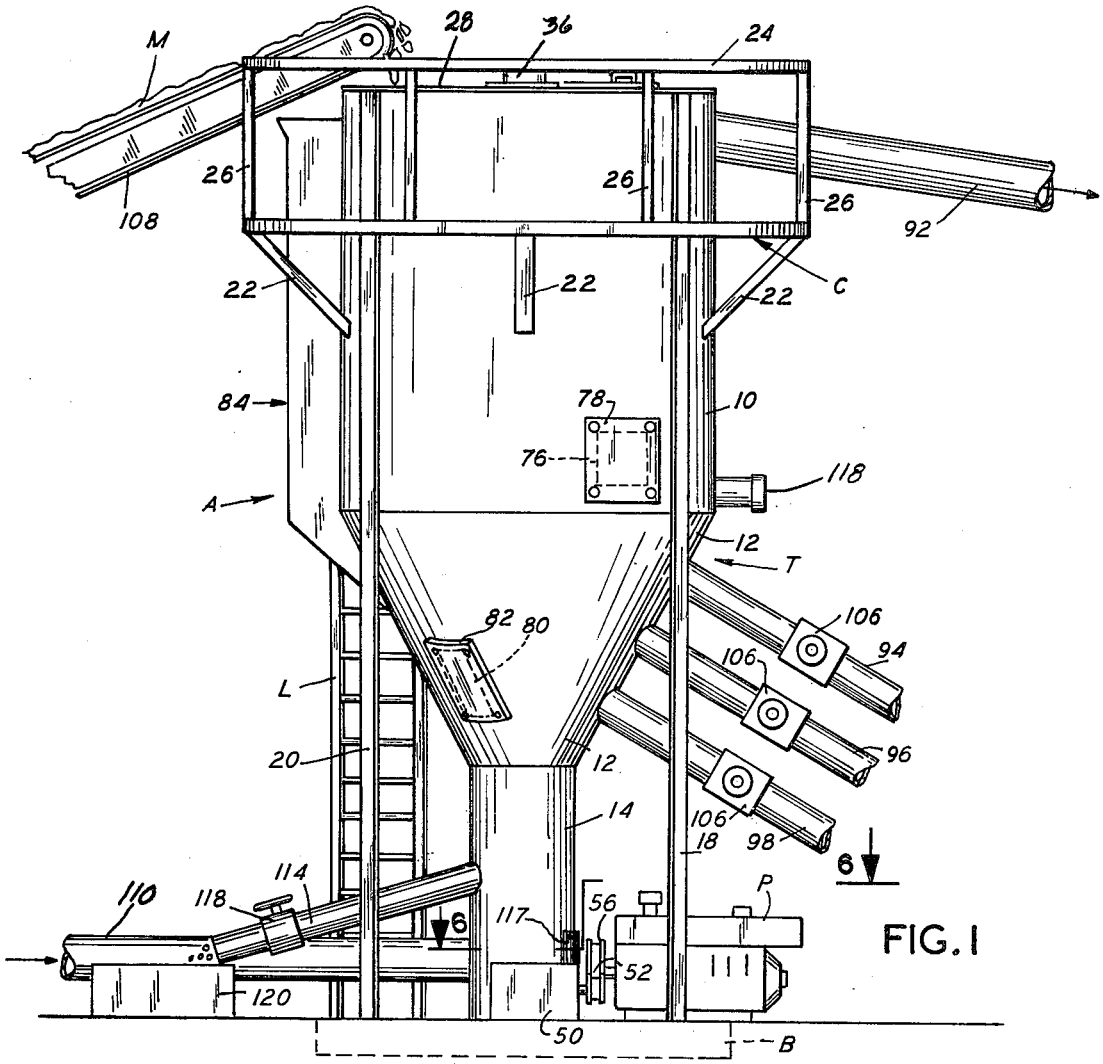
Figure 2:
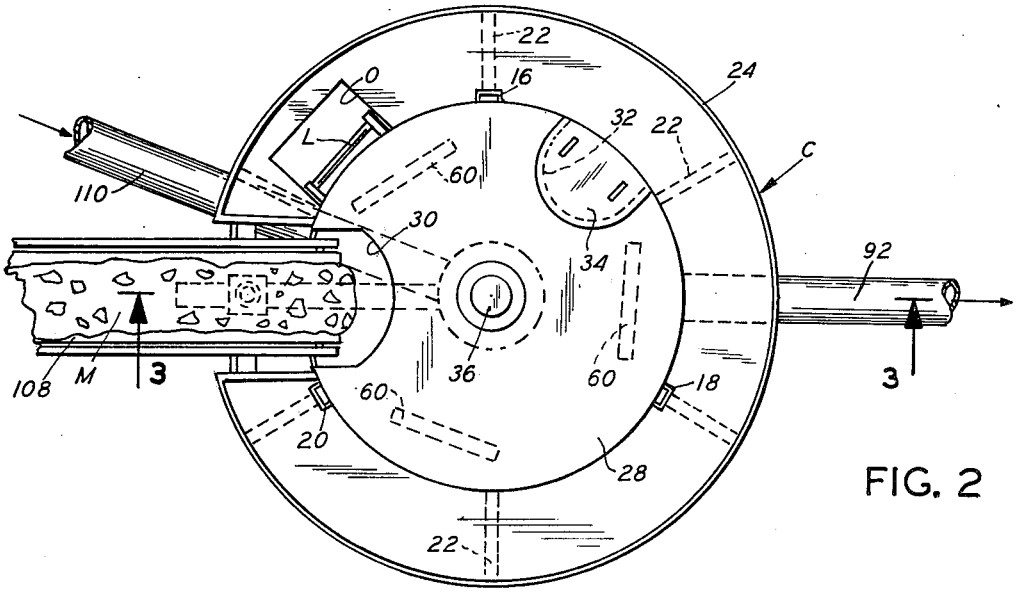
FIG. 2 is a top plan view of the same.

Referring to the drawings in detail, the apparatus for separating minerals and the like from earth and the like A, hereinafter referred to as the separator, includes the upper cylindrical chamber 10 which terminates at its lower end in the intermediate truncated cone chamber portion 12 which in turn terminates in the lower cylindrical chamber 14.

The chambers 10 and 12 form a tank T leading to the lower chamber 14 and the tank is supported by the uprights 16, 18, and 20 connected thereto and anchored in the concrete base B. Secured adjacent to the top end of the tank T is the circular catwalk C supported by the braces 22 connected to the tank and on which is mounted the circular guard rail 24 supported by the vertical posts 26. The catwalk C is accessible by means of the ladder L extended through the opening O of the catwalk.

The numeral 28 designates a cover for the top end of the upper chamber 10. Formed in the cover 28 is the material receiving opening 30 and the access opening 32 covered by the access door 34 for entrance into the hopper for inspection and repairs. Positioned axially on the cover 28 is the bearing 36 in which the upper end of the auger shaft 38 is rotatably mounted. The lower end of the shaft 38 is rotatably mounted in the bearing 40 mounted on the bottom sealer plate 42 secured within the lower chamber 14 and spaced from the base plate 44 which provides a chamber for the drive bevel gear 46 mounted on the lower end of the shaft which protrudes through the sealer plate 42.

Bevel gear 46 is driven by spur gear 48 through the gear box 50 driven by the belt 52 on pulley 54 of the gear box and the pulley 56 of the source of power P which may be a gasoline engine or the like. The shaft 38 has the auger blade 58 helically positioned thereon and so as to thrust upwardly. Secured to the underside of the top 28 are the spaced top deflector plates 60 which are arced to deflect material downwardly into the hopper. The numeral 62 designates a shredder formed of the base 64 on which is mounted the spaced teeth 66 and the deflector plate 68. The teeth 66 depend obliquely downwardly. The base 64 of the deflector is secured to the inner surface of the sidewall of the chamber 10 by welding or other securement whereby the deflector plate is radially extended relative to the longitudinal axis of the tank. Three shredders are provided which are identical and equally spaced on the inner surface of the wall of the chamber 10. The identical shredders bear identical reference numerals but accompanied by a lower case letter *a* and *b*.

Further provided are the identical deflectors 70, **70*a*, and 70*b*, each including a right angle formation secured at its legs to the inner surface of the wall of the chamber 10**.

Secured to and extending radially outwardly on the shaft 38 are the spaced beaters 72. The beaters 72 are identical and each includes an arcuate bar secured at its inner end to the shaft 38 and curving upwardly towards the top 28. The lower beaters 74 are shortened to accommodate the shape of the intermediate chamber 12.

The chamber 10 is formed with an access opening 76 covered by the cover 78 and similarly the chamber 12 is formed with an access opening 80 closed by the cover 82. The numeral 84 designates a bypass feed conduit attached to the outside of the chamber 10 and terminating at the opening 86 formed at the juncutre of the chambers 10 and 12. The bottom end 88 of the conduit is angularly disposed to the longitudinal axis of the tank to direct material toward and into the intermediate chamber. Secured to the opening 90 formed at the upper end of the chamber 10 is the overflow outlet pipe 92 which extends from the chamber slightly downwardly to a disposal area not shown.

Figure 8:
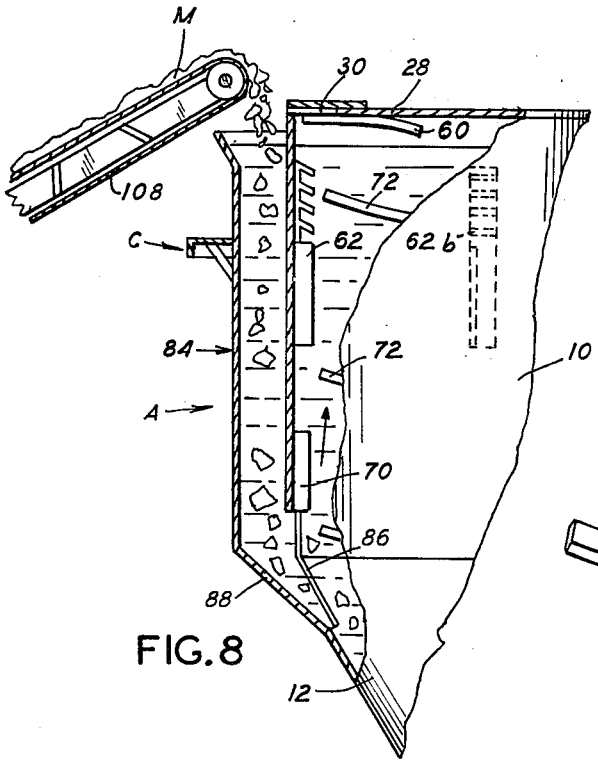
FIG. 8 is a sectional view of the bypass feed for the hopper showing a feed into the bypass.
Figure 9:
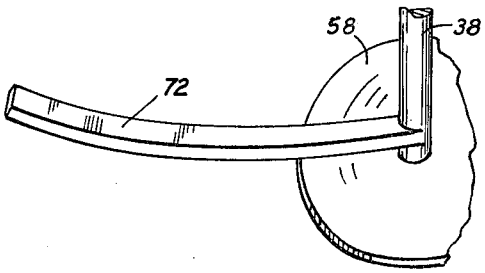
FIG. 9 is a perspective view of a beater arm removed from the device.

Additionally provided are the identical intermediate outlet pipes 94, 96, and 98 secured to chamber 12 at openings 100, 102, and 104 and directed downwardly for positive flow from the intermediate chamber 12. Each pipe 94, 96, and 98 is provided with a conventional control valve 106. The pipes are directed to a disposal area not shown. A conventional belt conveyor 108 is positioned adjacent the upper end of the tank so as to direct material M into and through the opening 30 into chamber 10. Alternatively the conveyor 108 is positioned to convey material into the bypass feed conduit 84 best shown in FIG. 8.

The numeral 110 designates a fluid feed injection pipe which is connected to opening 112 of the chamber 14. A fluid is supplied to pipe 110 by a conventional source not shown. Further provided is the material removal pipe 114 secured at its inner end to opening 116 formed in the wall of lower chamber 14 and spaced above the fluid inlet pipe 110. The pipe 114 extends downwardly from the chamber 14 to facilitate flow and flow therethrough is controlled by the conventional control valve 118. Positioned adjacent the outer end of pipe 114 is the collector bin 120 which collects the desired separated material. Formed in the wall of the chamber 14 is the cleanout opening 115 covered by the removable plate 117.

Figure 3:
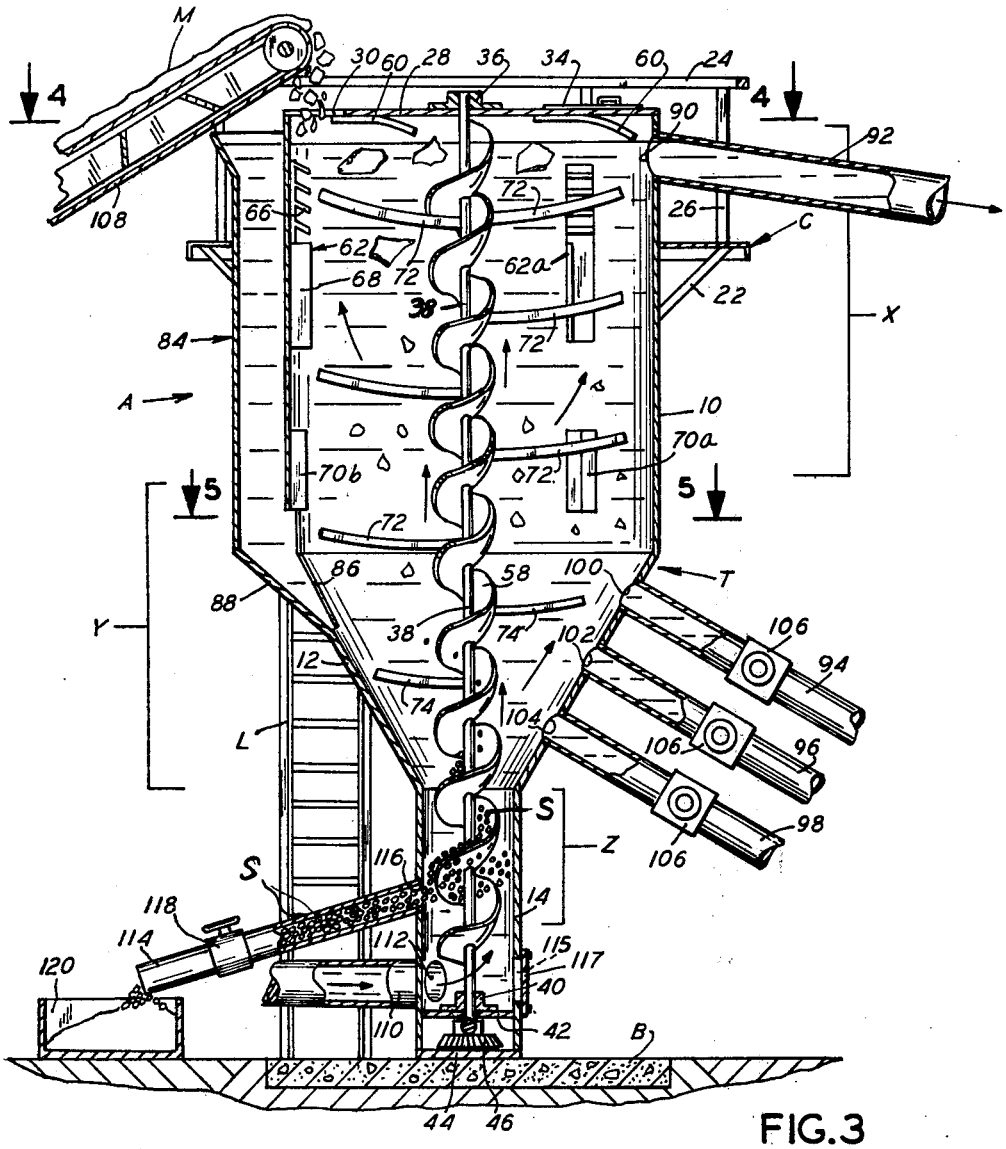
FIG. 3 is a sectional view on the line 3—3 of FIG. 2.
Figure 4:
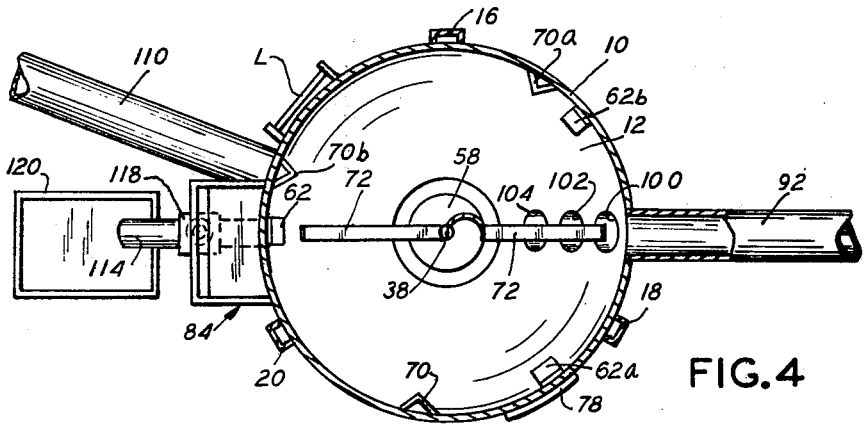
FIG. 4 is a sectional view on the line 4—4 of FIG. 3.
Figure 5:
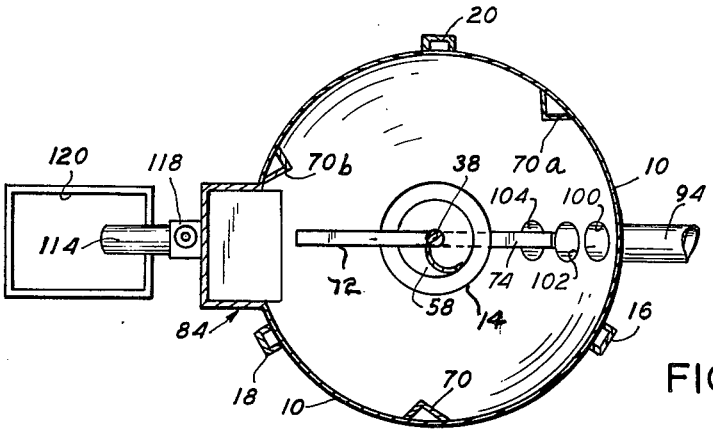
FIG. 5 is a sectional view on the line 5—5 of FIG. 3.
Figure 6:
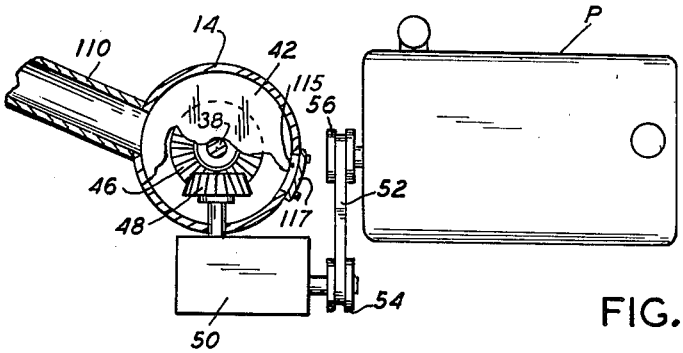
FIG. 6 is a sectional view on the line 6—6 of FIG. 1.
Figure 7:
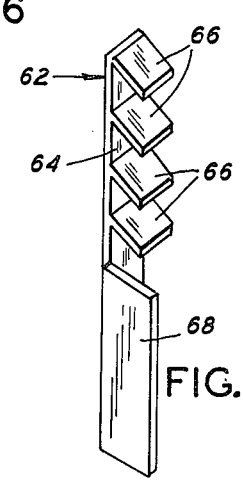
FIG. 7 is a perspective view of a shredder removed from the apparatus.

The device can be said to be divided into three internal areas X, Y, Z, according to its operation, see FIG. 3. As will be seen the elements in area X do the agitating and separation of the heavy material from earth grass etc. The elements in area Y separate relatively medium weight material from the heavy and in area Z the elements separate the heavy material such as lead shot and directs it out the outlet pipe. A fluid is continuously supplied under pressure to fluid feed injection pipe 110 leading into chamber 14 of area Z. The fluid level in the device extends up to overflow outlet pipe 92. As the fluid is pumped into the device there is an upward movement in the fluid due to the pressure thereof, the convolutions of the auger blade 58 and the beaters 72. The beaters also aid in breaking up the material to be separated.

The bypass 84 is used for material to be separated which is lighter in weight than lead BB shot mentioned herein. Also when heavy material such as BB shot is imbedded in dry earth chunks which is quite buoyant the shot in the chunks tends to flow out the outlet 92. In introducing such material into the bypass 84 the same enters the unit into the intermediate tank portion 12 where the separation process begins. By the time the earth and the heavy material reaches the top of tank portion 10 the same have become separated as set forth and the light weight earth passes out outlet 92.

Also provided is the inlet 118 located at the lower end of the tank portion 10 through which a liquid material such as mineral bearing silt may be pumped directly into the tank portion 10 rather than using conveyor 108. Such is the case, for the silt cannot by conveyed but must be pumped.

Material M such as earth with lead BB shot and broken pieces of clay pigeons mixed therewith and to be separated is deposited into the opening 30 by means of the conveyor 108. The lead shot falls due to gravity, and the abovementioned upward movement of fluid together with the lighter specific gravity causes the earth pieces and particles to remain at the upper end of the chamber 10. Due to the circular motion and the vortex created in the fluid by the auger, the earth pieces are caused to exit out the overflow pipe 92 at the top of area X. In the use of the lead BB shot to shoot clay pigeons the pieces of the clay pigeons and light rock picked up and which are heavier than the earth pieces fall to area Y and exit out the intermediate outlet pipes 94, 96, and 98.

As the process is carried out the shredders 62, **62*a*, and 62*b* shred and break up earth lumps and forces heavier material downwardly in the unit. The deflectors 70, 70*a*, and 70*b* force fluid and material to the center axis of the device. Additionally, the beaters 72 aid in breaking up the material to be separated. The lead shot falls to and exits out the outlet hole 116 and out through outlet pipe 114. Due to the upward pressure of the fluid supply out of pipe 110 maintained in chamber 14 the lead shot exits out through hole 116 through pipe 114 and it does not move downwardly below outlet 116** due to the upward fluid pressure maintained. It is a balancing of fluid pressure relative to the falling lead shot.

The device may also be used to separate artifacts, coins, and jewelry from earth.

Having thus described the invention, what is claimed as new and desired to be secured by Letters Patent is:

1. An apparatus for separating minerals and the like from earth and the like comprising:

(a) a tank including an upper portion terminating in and communicating with
(b) a lower portion having a frusto-conical formation,
(c) said lower portion terminating in and communicating with a chamber,
(d) outlet means leading from the top of said upper tank portion,
(e) inlet means leading to the top of said upper tank portion,
(f) rotative means for causing a flow of fluid in said tank portions from within said chamber upwardly and into said lower and upper portions of said tank,
(g) baffle members secured to the inside of the tank,
(h) bar members carried by said flow causing means and extending into said tank,
(i) at least one outlet means leading from said lower portion of said tank,
(j) an outlet for separated material leading from said chamber, and
(k) a fluid inlet leading into said chamber removed from said outlet for separated material,
(l) said baffle members including shredding means, and
(m) said rotative means includes an auger extending through said chamber and said lower and upper portions of said tank.

2. The apparatus of claim 1 in which said bar members are arcuate.

3. The apparatus of claim 2 in which said shredding means includes teeth connected to said baffle members.

4. An apparatus for separating minerals and the like from earth and the like comprising:

(a) a tank including an upper portion terminating in and communicating with
(b) a lower portion having a frusto-conical formation,
(c) said lower portion terminating in and communicating with a chamber,
(d) outlet means leading from the top of said upper tank portion,
(e) inlet means leading to the top of said upper tank portion,
(f) rotative means for causing a flow of fluid in said tank portions from within said chamber upwardly and into said lower and upper portions of said tank,
(g) baffle members secured to the inside of the tank,
(h) bar members carried by said flow causing means and extending into said tank,
(i) at least one outlet means leading from said lower portion of said tank,
(j) an outlet for separated material leading from said chamber, and
(k) a fluid inlet leading into said chamber removed from said outlet for separated material,
(l) said baffle members including shredding means.

* * * * *